US007651337B2

(12) United States Patent
McNamara

(10) Patent No.: US 7,651,337 B2
(45) Date of Patent: Jan. 26, 2010

(54) ELECTRICAL CONNECTOR WITH DIVIDER SHIELDS TO MINIMIZE CROSSTALK

(75) Inventor: David Michael McNamara, Amherst, NH (US)

(73) Assignee: Amphenol Corporation, Wallingford, CT (US)

( * ) Notice: Subject to any disclaimer, the term of this patent is extended or adjusted under 35 U.S.C. 154(b) by 36 days.

(21) Appl. No.: 11/882,752

(22) Filed: Aug. 3, 2007

(65) Prior Publication Data

US 2009/0035955 A1 Feb. 5, 2009

(51) Int. Cl.
*H01R 12/00* (2006.01)

(52) U.S. Cl. ..... 439/65

(58) Field of Classification Search ..... 439/65, 439/608–610, 108, 101, 74, 75, 947, 701, 439/79, 607.08, 607.07, 607.02, 607.05, 439/607.11

See application file for complete search history.

(56) References Cited

U.S. PATENT DOCUMENTS

| | | | | |
|---|---|---|---|---|
| 5,403,206 | A | 4/1995 | McNamara et al. | |
| 5,702,258 | A | 12/1997 | Provencher et al. | |
| 5,980,321 | A | 11/1999 | Cohen et al. | |
| 5,993,259 | A | 11/1999 | Stokoe et al. | |
| 6,293,827 | B1 * | 9/2001 | Stokoe | 439/607.07 |
| 6,379,188 | B1 | 4/2002 | Cohen et al. | |
| 6,409,543 | B1 | 6/2002 | Astbury, Jr. et al. | |
| 6,431,914 | B1 | 8/2002 | Billman | |
| 6,506,076 | B2 | 1/2003 | Cohen et al. | |
| 6,602,095 | B2 | 8/2003 | Astbury, Jr. et al. | |
| 6,739,918 | B2 | 5/2004 | Cohen et al. | |
| 6,764,349 | B2 | 7/2004 | Provencher et al. | |
| 6,769,935 | B2 | 8/2004 | Stokoe et al. | |
| 6,776,659 | B1 | 8/2004 | Stokoe et al. | |
| 6,814,619 | B1 | 11/2004 | Stokoe et al. | |
| 6,827,611 | B1 | 12/2004 | Payne et al. | |
| 6,872,085 | B1 | 3/2005 | Cohen et al. | |
| 7,048,585 | B2 | 5/2006 | Milbrand, Jr. et al. | |
| 7,074,086 | B2 | 7/2006 | Cohen et al. | |
| 7,108,556 | B2 | 9/2006 | Cohen et al. | |
| 7,163,421 | B1 | 1/2007 | Cohen | |
| 7,278,886 | B2 * | 10/2007 | Cohen et al. | 439/608 |
| 2002/0098727 | A1 * | 7/2002 | McNamara et al. | 439/108 |
| 2004/0115968 | A1 | 6/2004 | Cohen | |
| 2004/0264153 | A1 | 12/2004 | Payne et al. | |
| 2005/0048817 | A1 | 3/2005 | Cohen et al. | |
| 2006/0068640 | A1 | 3/2006 | Gailus | |
| 2007/0042639 | A1 | 2/2007 | Manter et al. | |
| 2007/0054554 | A1 | 3/2007 | Do | |

* cited by examiner

*Primary Examiner*—Edwin A. Leon
(74) *Attorney, Agent, or Firm*—Blank Rome LLP

(57) ABSTRACT

A wafer for an electrical connector includes a conductive shield plate, a plurality of signal conductors disposed on the shield plate, and a divider shield. Each of the plurality of signal conductors has at least one contact portion. The divider shield is disposed on the shield plate aligned with the at least one contact portion and is made of conductive metal. The divider shield is separate from and coupled to the shield plate.

20 Claims, 9 Drawing Sheets

ELECTRICAL CONNECTOR WITH DIVIDER SHIELDS TO MINIMIZE CROSSTALK

FIELD OF THE INVENTION

The present invention relates generally to electrical interconnection systems. More particularly, the present invention relates to interconnection systems with crosstalk reduction.

BACKGROUND OF THE INVENTION

For ease of manufacture and cost effectiveness, an electronic system is generally manufactured on several separate printed circuit boards. These separate printed circuit boards are then connected to one another by electrical connectors. Typically, one printed circuit board serves as a backplane. Other printed circuit boards, often called daughter boards or daughter cards, are then connected to the backplane by electrical connectors as part of the electronic system.

To meet the demand for electronic systems that are more compact, faster, and more complex, increasingly more circuits are placed within a given area of each printed circuit board, and those circuits operate at increasingly higher frequencies. Correspondingly, the electrical connectors between the printed circuit boards have to pass data at increasingly higher rates. For fast data processing, current electronic systems require faster data transmission between their component printed circuit boards.

However, as a result of increasing signal frequencies, the connectors encounter more electrical noise. The electrical noise often manifests itself as signal reflections, crosstalk, electromagnetic radiation, or other similar forms of electrical noise. Signal reflection occurs when a portion of a signal being transmitted is reflected back to the signal source instead of being transmitted to the signal destination. Signal reflections are caused by signal path imperfections that give rise to impedance mismatching. Also, changes in the signal path characteristics, particularly abrupt changes, can cause signals to be reflected.

Crosstalk is electromagnetic coupling of one signal path with another signal path. The coupling results in one signal affecting another nearby signal. To reduce electrical noise in the form of crosstalk, signal paths are arranged so that the signal paths are spaced farther apart from each other and nearer to a shield plate which is generally the ground plate, as described in U.S. Patent Application Pub. No. 2004/0264153 to Payne et al., entitled "Printed Circuit Board for High Speed, High Density Electrical Connector with Improved Cross-Talk Minimization, Attenuation and Impedance Mismatch Characteristics," which is incorporated by reference herein in its entirety. Therefore, the signal paths tend to couple electromagnetically more with the shield plate and less with each other. For a particular level of crosstalk, the signal paths can be placed closer to each other as long as sufficient electromagnetic coupling to the shield plate or a ground conductor is maintained.

Also, in a region where the signal path electrically connects to another circuit, manufacturing costs are relatively higher since the signal path must be formed and shaped to provide an acceptable electrical connection that is mechanically durable. Such connections are typically more difficult to manufacture because a more complicated shape is required and therefore is more costly to form. The connections also need electromagnetic coupling to the shield plate or to ground conductors to minimize crosstalk.

One approach to lower costs and provide shielding between adjacent connections is to use plastic containing conductive materials, such as the connector described in U.S. Patent Application Pub. No. 2007/0042639 to Manter et al., entitled "Connector with Improved Shielding in Mating Contact Region," which is incorporated by reference herein in its entirety. However, the use of plastic containing conductive materials between signal paths does not provide the stiffness, the shielding, or the lower relative manufacturing cost of using a metal shield.

Therefore, there is a need in the art for a high speed, high density electrical connector design that minimizes crosstalk, provides increased conductive metal content around the contact region, and lowers manufacturing costs.

SUMMARY OF THE INVENTION

The present invention provides increased metal presence around the contact region of an electrical connector to minimize crosstalk. The present invention also provides a component that can be manufactured separately from the contact region and at low cost.

One embodiment of the present invention provides a wafer for an electrical connector. The wafer includes a conductive shield plate, a plurality of signal conductors disposed on the shield plate, and a divider shield. Each of the plurality of signal conductors has at least one contact portion. The divider shield is disposed on the shield plate aligned with the at least one contact portion and is made of conductive metal. The divider shield is separate from and coupled to the shield plate.

Another embodiment of the present invention provides an electrical connector. The electrical connector includes at least one wafer and an end module. The wafer has a conductive shield plate, a plurality of signal conductors disposed on the shield plate, and a divider shield. Each signal conductor has at least one contact portion, and the divider shield is disposed on the shield plate aligned with the at least one contact portion and is made of conductive metal. The divider shield is separately formed and coupled to the shield plate.

Yet another embodiment of the present invention provides a shield plate for a wafer. The shield plate includes a plurality of signal conductors, each signal conductor having an intermediate portion and a contact portion; a conductive layer formed to receive the intermediate portion of the plurality of signal conductors; and at least one divider shield disposed substantially orthogonal to a plane of the conductive layer and disposed between adjacent contact portions of adjacent signal conductors. The divider shield is made of conductive metal and is separate from and coupled to the shield plate.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-9, an electrical connector 10 provides improved shielding by increasing the presence of conductive material in the contact region. The improved shielding can be manufactured separately from the contact region and is inexpensive to manufacture.

Figure 1:
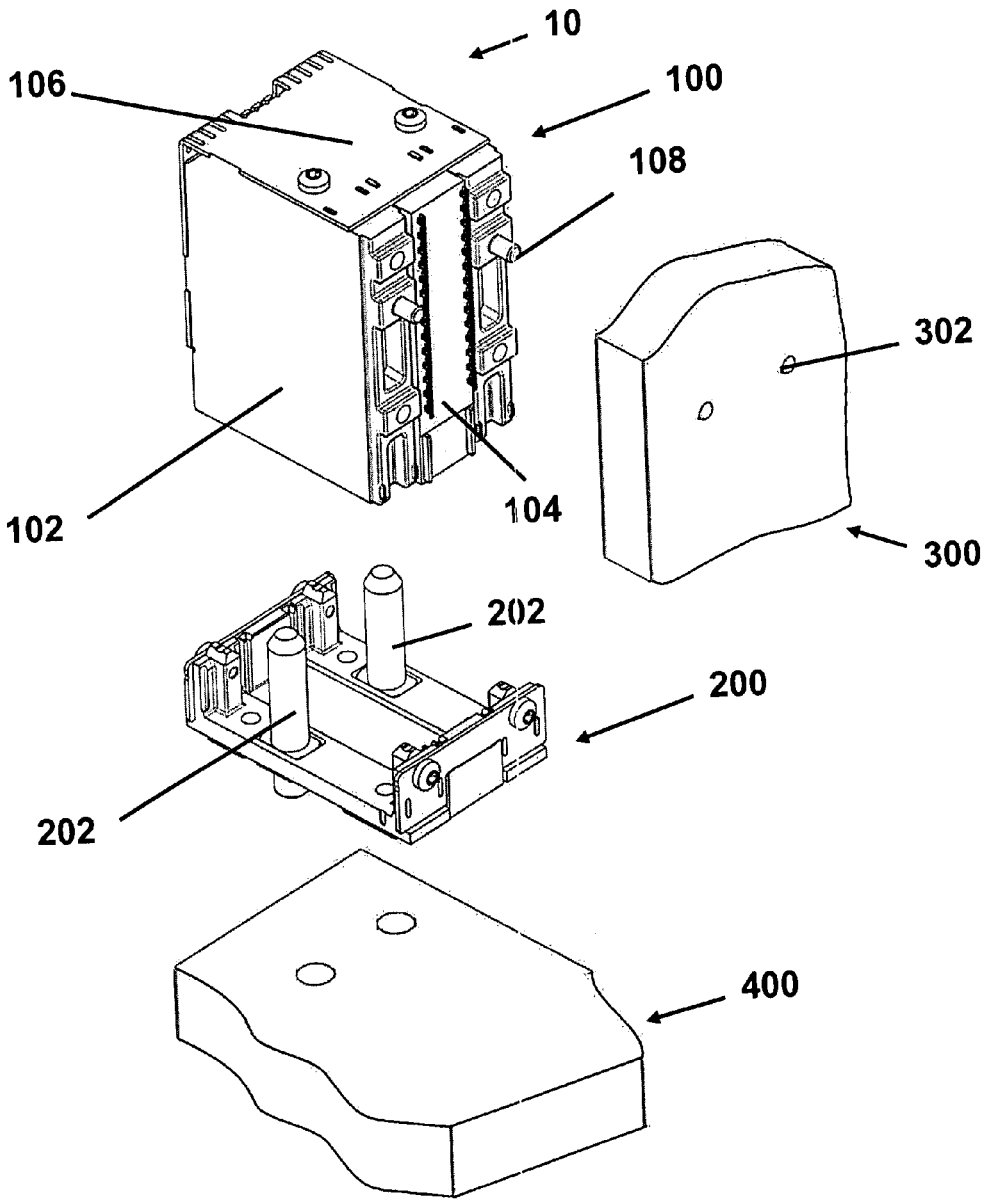
FIG. 1 is a perspective view of an electrical connector in accordance with an embodiment of the invention.

Referring to FIG. 1, the electrical connector 10 is shown. The electrical connector 10 includes a daughter card connector 100 and a backplane connector 200. The electrical connector 10 provides signal pathways. The daughter card connector 100 is adapted to be mated to the backplane connector 200. In the embodiment shown, the daughter card connector 100 and the backplane connector 200 when mated with each other provide signal pathways for two printed circuit boards 300 and 400 that are at substantially right angles to one another.

However, the electrical connector 10 of the present invention is not intended to be limited to providing signal pathways to printed circuit boards, two circuits, or printed circuit boards substantially at right angles to one another. The electrical connector 10 may be formed to provide signal pathways to circuits other than printed circuit boards 300 and 400. The electrical connector 10 may provide signal pathways between any components sending, receiving, transferring, processing, or otherwise dealing with signals. The electrical connector 10 may also provide signal pathways to any number of signal sources and signal destinations. Further, the electrical connector 10 may be formed so that the signal source and signal destination may be at any orientation with respect to one another.

The daughter card connector 100 includes an end module 102 and at least one wafer 104. The end module 102 and the wafer 104 are coupled to each other by an assembling member 106. In the embodiment shown, the wafer 104, the end module 102, and the assembling member 106 are preferably formed separately, but the daughter card connector 100 may have the wafer 104, the end module 102, the assembling member 106, or any combination of the previous formed integrally with one another.

The end module 102 provides support and alignment for mounting and mating the daughter card connector 100 to the backplane connector 200. The end module 102 provides support to the wafer 104 by being placed adjacent to the wafer 104 to prevent buckling of the wafer 104 when a mechanical load is placed on the wafer 104. End modules are described, for instance, in "High Speed, High Density Electrical Connector," U.S. Patent Appl. Publ. No. 2006/0068640, to Gailus and "Printed Circuit Board for High Speed, High Density Electrical Connector with Improved Cross-Talk Minimization, Attenuation and Impedance Mismatch Characteristics," U.S. Patent Appl. Publ. No. 2004/0264153, to Payne et al., both of which are incorporated herein in their entirety. Preferably, the end module 102 is formed with substantially the same shape as the wafer. In the embodiment shown, the end module 102 includes a mating pin guide receptacle (not shown) and a printed circuit board alignment pin 108. The mating pin guide receptacle receives a mating pin 202 disposed on the backplane connector 200. The printed circuit board alignment pin 108 aligns the daughter card connector 100 with the printed circuit board 300 by mating with alignment pin receptacles 302.

Figure 2:
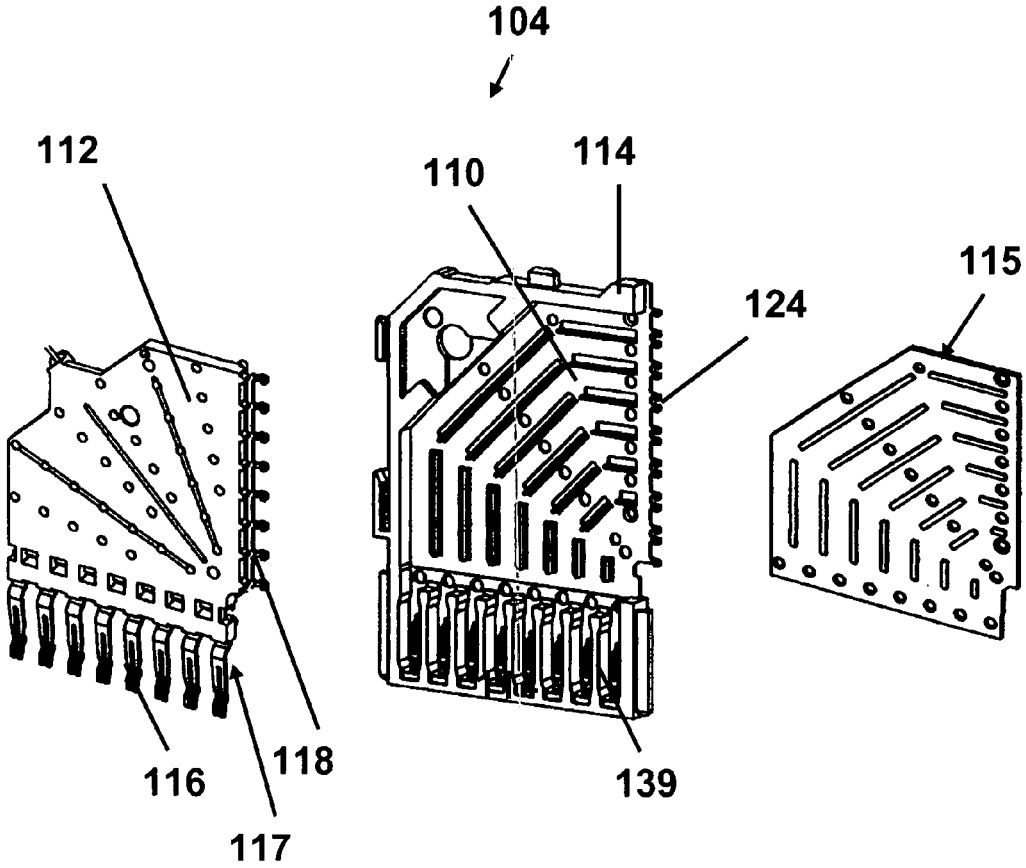
FIG. 2 is an exploded perspective view of a wafer of the electrical connector illustrated in FIG. 1.

Referring to FIG. 2, the wafer 104 is shown in an exploded perspective view. The wafer 104 includes signal conductors 117 and a shield plate 110. The signal conductors 117 are substantially disposed within a conductor insulation 112 so that the signal conductors 117 are electrically isolated from the shield plate 110. Also, the shield plate 110 is substantially disposed within a shield insulation 114 to prevent grounding of signals. The conductor insulation 112 is formed to align the signal conductors 117 with the shield plate 110. The conductor insulation 112 is also configured to engage the shield insulation 114 to form the wafer 104.

In the embodiment shown, the shield insulation 114 is disposed substantially around the circumference of the shield plate 110. The shield insulation 114 is not disposed around the grounding contact portion 124. Also, in place of the shield insulation 114, a panel 115 is disposed on the back side of the shield plate 110 away from the signal conductors 117. Thus, the shield plate 110 is sandwiched between conductor insulator 112 and panel 115 and is surrounded about its outer circumference by shield insulation 114. The panel 115 may be made of materials, such as semi-conductive materials, for example, plastic containing conductive materials, to provide improved electrical properties.

Preferably, the conductor insulation 112 and the shield insulation 114 are made of plastic. Suitable plastics include, but are not limited to, natural polymers, synthetic polymers, fluoropolymers, thermosetting plastics, thermoplastics, and other similar materials. Also, preferably the signal conductors 117 and the shield plate 110 are disposed in the conductor insulation 112 and shield insulation 114, respectively, by injection molding, or by a process whereby hot molten plastic is forced under pressure into a mold, and then the mold is cooled to freeze the plastic in the shape of the mold. For injection molding, thermosetting plastic or thermoplastics are preferred. Thermosetting plastics include, but are not limited to, epoxy, melamine, polyisoprene, phenolic, phenol formaldehyde, polyester, silicone, urea formaldehyde, and other similar materials. Thermoplastics include, but are not limited to, acetal, acrylic, acylonitrile-butadiene-styrene, cellulosics, polymethyl-methacrylate, polyamide, polyarylate, polycarbonate, polyester, polyethylene, polypropylene, polystyrene, polytetrafluoroethylene, polyurethane, polyvinyl chloride, neoprene, vinyl, and other similar materials.

Figure 3:
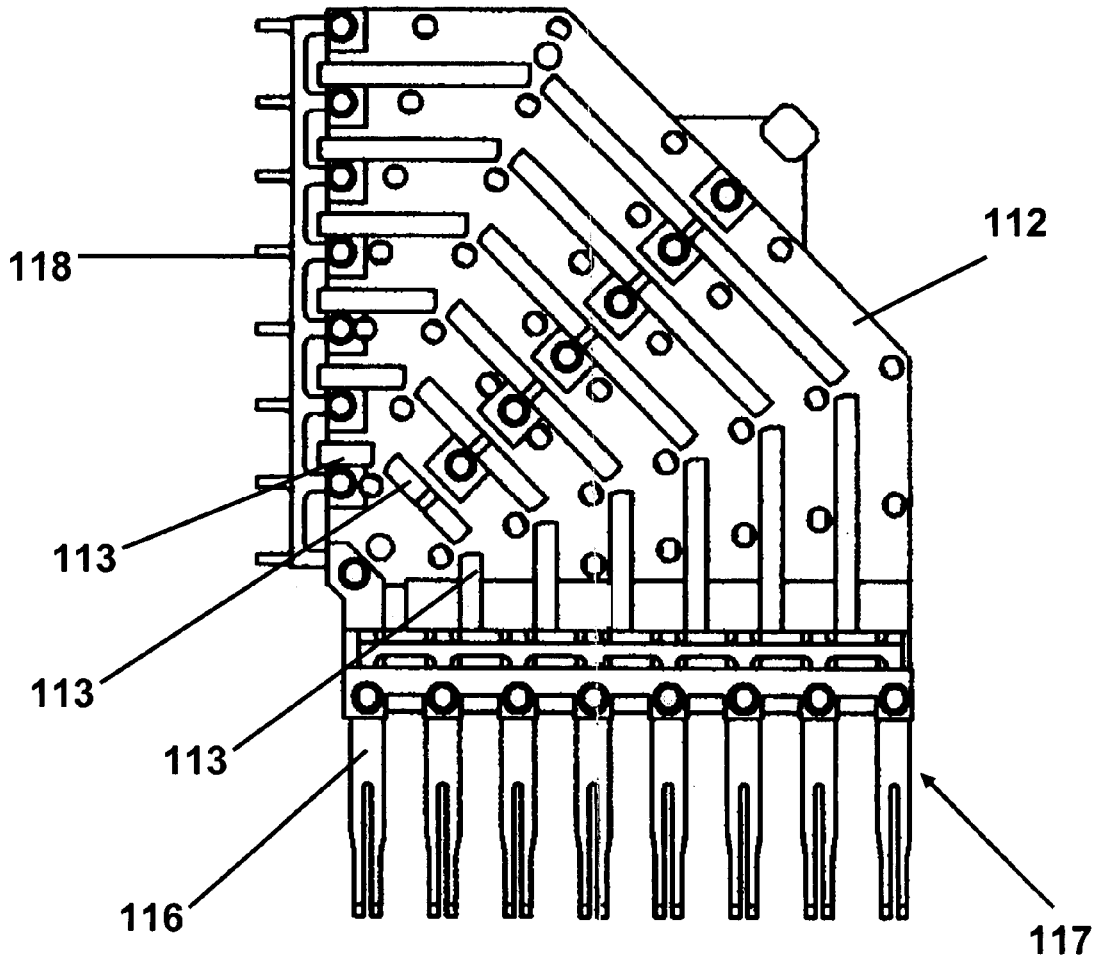
FIG. 3 is a plan view of signal conductors disposed within a conductor insulation of the wafer illustrated in FIG. 2.

Referring to FIG. 3, the signal conductors 117 disposed in the conductor insulation 112 are shown. The conductor insulation 112 includes grooves 113. The grooves 113 are configured to receive projections 126 (shown in FIG. 5) disposed on the shield plate 110. Preferably, the grooves 113 are deep enough so that the projections 126 do not touch the bottom of the groove 126.

Figure 4:
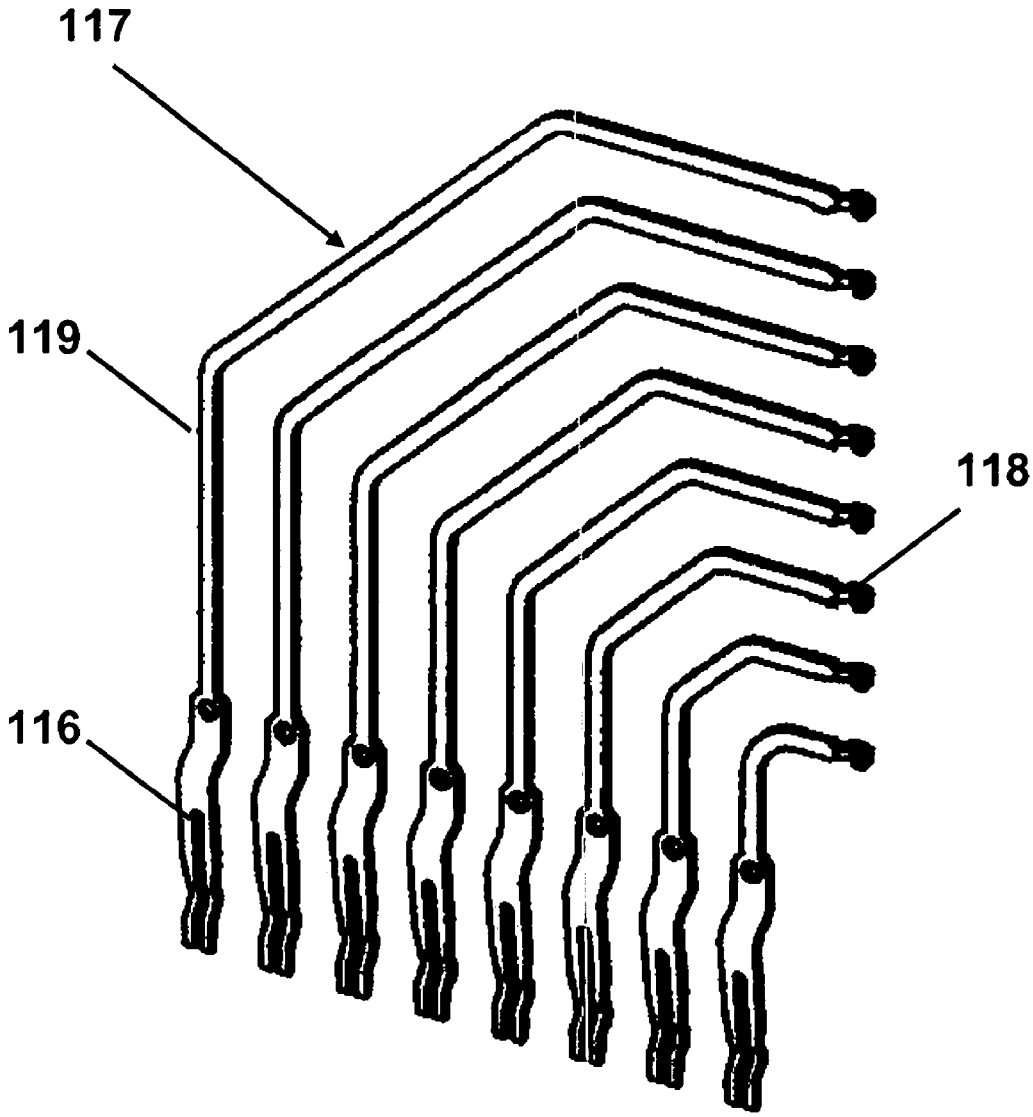
FIG. 4 is a perspective view of the signal conductors without conductor insulation illustrated in FIG. 3.

Referring to FIG. 4, the signal conductors 117 of FIGS. 2 and 3 are shown without the conductor insulation 112. The signal conductors 117 provide a signal pathway. The signal conductors 117 can also be differential signal pairs. The signal conductors 117 have at least one contact portion 116 at one end. In the embodiment shown, the signal conductors 117 each have contact portions 116 and 118 it opposite ends and intermediate portions 119 therebetween. The contact portions 116 and 118 provide electrical and mechanical coupling. The contact portions 116 and 118 can be a contact tail with a contact pad adapted for soldering to the printed circuit board, a press-fit contact, a pressure-mount contact, a paste-in-hole solder attachment, or another similar arrangement for electrical and mechanical coupling. Each of the contact portions 116 and 118 may be the same arrangement, or each of the contact portions 116 and 118 may be different arrangements for electrical and mechanical coupling.

The signal conductors 117 are preferably formed by stamping conductive metal and then deforming the stamped conductive metal into the desired shape to form contact portions. Preferably, the signal conductors 117 are formed by progressive die stamping, a method known in the art, where the metal advances through a stamping press which has a series of stations. Each station in the stamping press can modify the metal by stamping, bending, punching, or completing some other similar metalworking. As the stamping press opens and closes, the metal advances from one station to the next, and each station changes the configuration left on the conductive metal by the previous station. The signal conductors 117 are then substantially disposed within the conductor insulation 112, preferably by injection molding.

Figure 5:
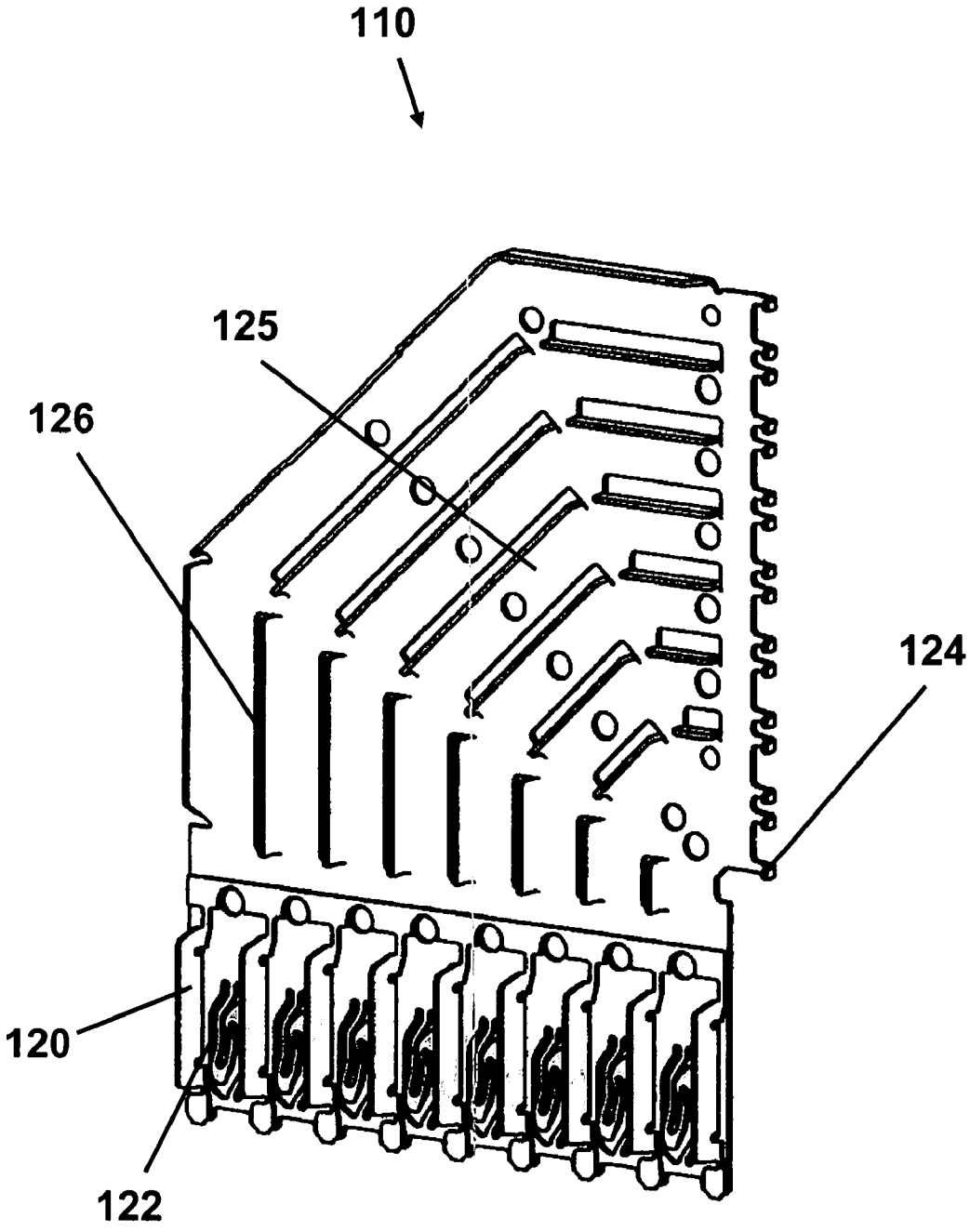
FIG. 5 is a perspective view of a shield plate of the wafer illustrated in FIG. 2.

Referring to FIG. 5, the shield plate 110 of FIG. 2 is shown without the shield insulation 114. The shield plate 110 provides shielding for adjacent signal conductors 117. The shield plate 110 is formed substantially is a flat plate and includes a grounding contact portion 122, at least one projection 126, and at least one divider shield 120. The shield plate 110 is made of a conductive metal so that the signal paths will tend to couple electromagnetically with the shield plate 110. Conductive metals include metals, both elemental and alloys, with or without plating, such as, but not limited to, silver, gold, copper, nickel, tin, aluminum, tin/lead alloy, brass, and other similar conductive metals.

The shield plate 110 may be formed by stamping conductive metal and then deforming the stamped conductive metal shape appropriately to form the shield plate 110. The shield plate 110 is preferably formed by progressive die stamping.

Disposed along at least one edge of shield plate 110 is at least one grounding contact portion 122 or 124. In the embodiment depicted, the shield plate 110 has two sets of grounding contact portions 122 and 124. The grounding contact portion 122 or 124 can be any suitable arrangement for forming an electrical contact including, but not limited to, a press-fit contact, a pressure-mount contact, a paste-in-hole solder attachment, a separable mating interface, or some other arrangement. Each of the grounding contact portion 122 or 124 may be the same arrangement or each grounding contact portion 122 or 124 may be a different arrangement for electrical and mechanical coupling.

The projections 126 and divider shields 120 provide shielding between adjacent signal conductors 117 to reduce crosstalk therebetween. The divider shields 120 provide shielding and reduce crosstalk between adjacent contact portions 116 of the signal conductors 117, while the projections 126 provide shielding for at least part of the intermediate portions 119 of the signal conductors 117. The divider shields 120 are preferably formed from conductive metal so as to increase the metal presence around the contact region.

The projections 126 are disposed substantially perpendicular to the plane of the shield plate 110 and spaced apart to receive the signal conductors 117. If the signal conductors 117 are within conductor insulation 112, then the projections 126 are spaced further apart from one another to accommodate the signal conductors 117 and the conductor insulation 112. The projections 126 form channels 125 where each channel 125 preferably receives a single signal conductor 117 or signal conductor 117 with conductor insulation 112. The channel 125 has a contour which substantially outlines the shape of the signal conductor 117 to be received in that channel 125. The projections 126 are preferably formed integrally with the shield plate 110 by progressive die stamping. Through progressive die stamping, portions of the shield plate 110 can be cut into and deformed to form the projections 126. To form a channel 125 that will accept the shape of a particular signal conductor, several projections 126 may be needed. In the embodiment shown, the channels 125 have three projections 126 on either side to accept a substantially linear shape with two bends. The projections 126 may also be disposed within shield insulation 114.

The divider shields 120 are disposed on the shield plate 110 near where the contact portions 116 of the signal conductors 117 are received by the shield plate 110. The divider shields 120 provide shielding and crosstalk reduction between adjacent contact portions 116 of the signal conductors 117. The divider shields 120 are disposed to extend substantially perpendicular to the plane of the shield plate 110 on either side of where the contact portion 116 is received. In the embodiment shown, the divider shields 120 have a substantially trapezoidal shape, however, any suitable shape may be used to form the divider shields 120 depending upon the particular application.

The divider shields 120 may be formed integrally with the shield plate 110, or the divider shields 120 may be formed separately and then attached to the shield plate 110. Preferably, the divider shields 120 are formed separately from the shield plate 110 and then attached to the shield plate 110 by suitable methods, such as by, but not limited to, press-fitting, screw fastening, bolting, rivet fastening, welding, and using an adhesive agent. If the divider shields 120 are formed separately, the divider shields 120 are preferable connected to a connecting strip, and the connecting strip is connected to the shield plate 110.

The shield plate 110 along with the projections 126 and the divider shields 120 may be disposed in the shield insulation 114, however preferably only the shield plate 110 and the divider shields 120 are disposed in the shield insulation 114 by injection molding, as best shown in FIG. 2. When the divider shields 120 are encased by the shield insulation 114, they form insulated divider shields 139 (shown in FIG. 2). The insulated divider shields 139 are formed on the shield plate 110 near the location at which the contact portions 116 of the signal conductors 117 are received by the shield plate 110. The insulated divider shields 139 are formed to extend substantially perpendicular to the plane of the shield plate 110 on either side of where the contact portion 116 is received. The insulated divider shields 139 are shaped to substantially conform to the shape of the contact portion 116.

As further shown in FIG. 2, the shield insulation 114 is provided only on one side of the shield plate 110 so that the shield plate 110 is sandwiched between the conductor insulation 112 and the panel 115. The shield insulation 114 is made of plastic or other similar material. Plastics include, for example, natural polymers, synthetic polymers, fluoropolymers, thermosetting plastics, thermoplastics, and other similar materials. For injection molding, thermosetting plastic or thermoplastics are preferred. Thermosetting plastics include, but are not limited to, epoxy, melamine, polyisoprene, phenolic, phenol formaldehyde, polyester, silicone, urea formaldehyde, and other similar materials. Thermoplastics include, but are not limited to, acetal, acrylic, acylonitrile-butadiene-styrene, cellulosics, polymethyl-methacrylate, polyamide, polyarylate, polycarbonate, polyester, polyethylene, polypropylene, polystyrene, polytetrafluoroethylene, polyurethane, polyvinyl chloride, neoprene, vinyl, and other similar materials.

Figure 6:
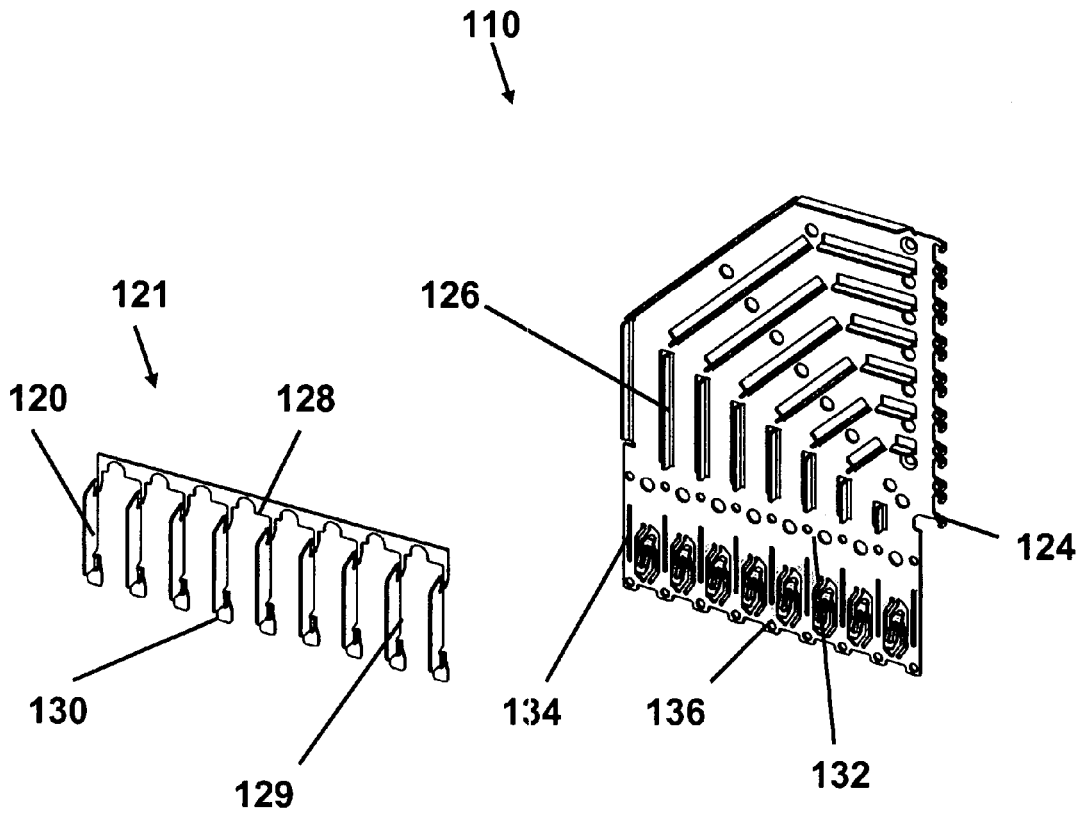
FIG. 6 is an exploded perspective view of the shield plate and a divider shield of the shield plate illustrated in FIG. 5.

Referring to FIG. 6, the divider shields 120 (of FIGS. 2 and 5) are shown formed separately before attachment to the shield plate 110. Separately formed divider shields 120 provide relatively larger metal shields than divider shields 120 formed integrally with the shield plate 110. The divider shields 120 of the present invention can have any suitable size and shape. The divider shields 120 can also be formed integrally with the shield plate 110, however they would be limited in size by the amount of metal that can be cut from and deformed away from the shield plate 110 without compromising structural integrity, adjacent design features, and other similar concerns.

When formed separately, the divider shields 120 are formed by stamping a sheet of conductive metal, preferably by progressive die stamping, and then attaching to the shield plate 110, such as by press-fit. In the embodiment depicted, a divider shield assembly 121 is formed with the divider shields 120, a tab 129, a connecting strip 128, and a connecting foot 130. Preferably all the divider shields 120 are formed integrally with the connecting strip 128 so that multiple divider shields 120 extend downwardly from the connecting strip 120 and project outwardly from the face of the shield plate 110. Each divider shield 120 has the tab 129 and the connecting foot 130. The tabs 129 are inserted into the slots 134 of the shield plate 110 to couple the divider shield assembly 121 to the shield plate 110. First posts (not shown) are disposed on the back side of the connecting strip 128 to couple the divider shield assembly 121 to the shield plate 110 by inserting the first posts into holes 132 on the shield plate 110. Similarly, second posts (not shown) are disposed on the back side of the connecting foot 130. The divider shield assembly 121 couples to the shield plate 110 by inserting the second posts into holes 136 on the shield plate 110. The first and second posts and the holes 132 and 136 may form a press-fit coupling, a snap coupling, a rivet coupling or other similar couplings. The conductive metal used to form the divider shield assembly 121 may be an elemental metal or an alloy, plated or unplated, and includes, but is not limited to, silver, gold, copper, nickel, tin, aluminum, tin/lead alloy, brass, and other similar conductive metals.

Similarly formed divider shields 120 can be used to replace some or all of the projections 126. Thus, projections 126 would be affixed at one or both ends to a connecting strip. The corresponding portion of the shield plate 110 can be substantially planar and more continuous.

Figure 7:
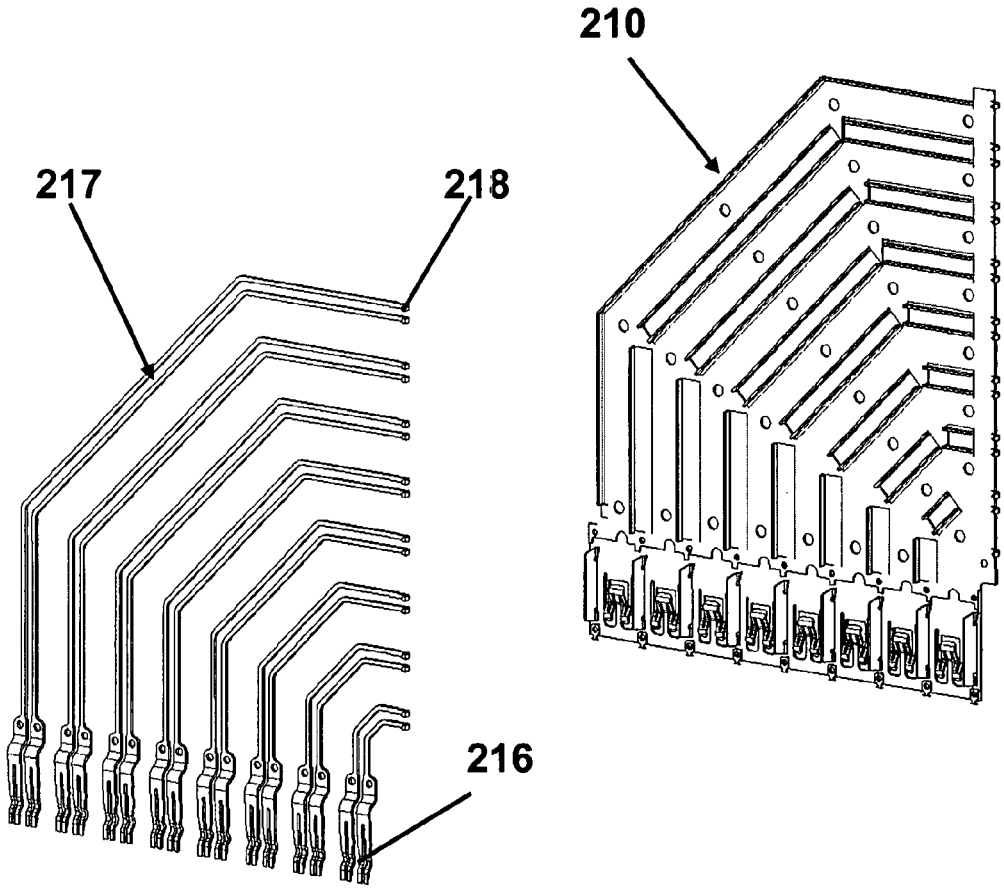
FIG. 7 is a perspective view of a shield plate and differential signal conductors in accordance with another embodiment of the present invention.

Referring to FIG. 7, a shield plate 210 for differential signal conductors 217 is shown. For clarity, the description of the components which are substantially the same as the first embodiment of the present invention is omitted. The shield plate 210 provides shielding for adjacent differential signal conductors 217. The differential signal conductors 217 include at least two conductive pathways that carry a differential signal. Differential signals are signals represented by a pair of conducting paths, called a "differential pair." The voltage difference between the conductive paths represents the signal. Preferably, two conducting pathway are arranged to run parallel to and near each other. The differential signal conductors 217 are made of a conductive metal. Conductive metals include metals, both elemental and alloys, with or without plating, such as, but not limited to, silver, gold, copper, nickel, tin, aluminum, tin/lead alloy, brass, and other similar conductive metals.

The differential signal conductors 217 are shown without the conductor insulation 112. The differential signal conductors 217 provide a signal pathway. Each of the differential signal conductors 217 have at least one contact portion 216 at one end. In the embodiment shown, the differential signal conductors 217 have contact portions 216 and 218 at opposite ends. The contact portions 216 and 218 provide electrical and mechanical coupling. The contact portions 216 and 218 can be a contact tail with a contact pad adapted for soldering to the printed circuit board, a press-fit contact, a pressure-mount contact, a paste-in-hole solder attachment, or another similar arrangement for electrical and mechanical coupling. Each of the contact portions 216 and 218 may be the same arrangement, or each of the contact portions 216 and 218 may be different arrangements for electrical and mechanical coupling.

The differential signal conductors 217 are preferably formed by stamping conductive metal and then deforming the stamped conductive metal into the desired shape to form contact portions 216 and 218. Preferably, the differential signal conductors 217 are formed by progressive die stamping, a method known in the art, where the metal advances through a stamping press which has a series of stations. Each station in the stamping press can modify the metal by stamping, bending, punching, or completing some other similar metalworking. As the stamping press opens and closes, the metal advances from one station to the next, and each station changes the configuration left on the conductive metal by the previous station. The differential signal conductors 217 are then substantially disposed within the conductor insulation 112, preferably by injection molding.

Figure 8:
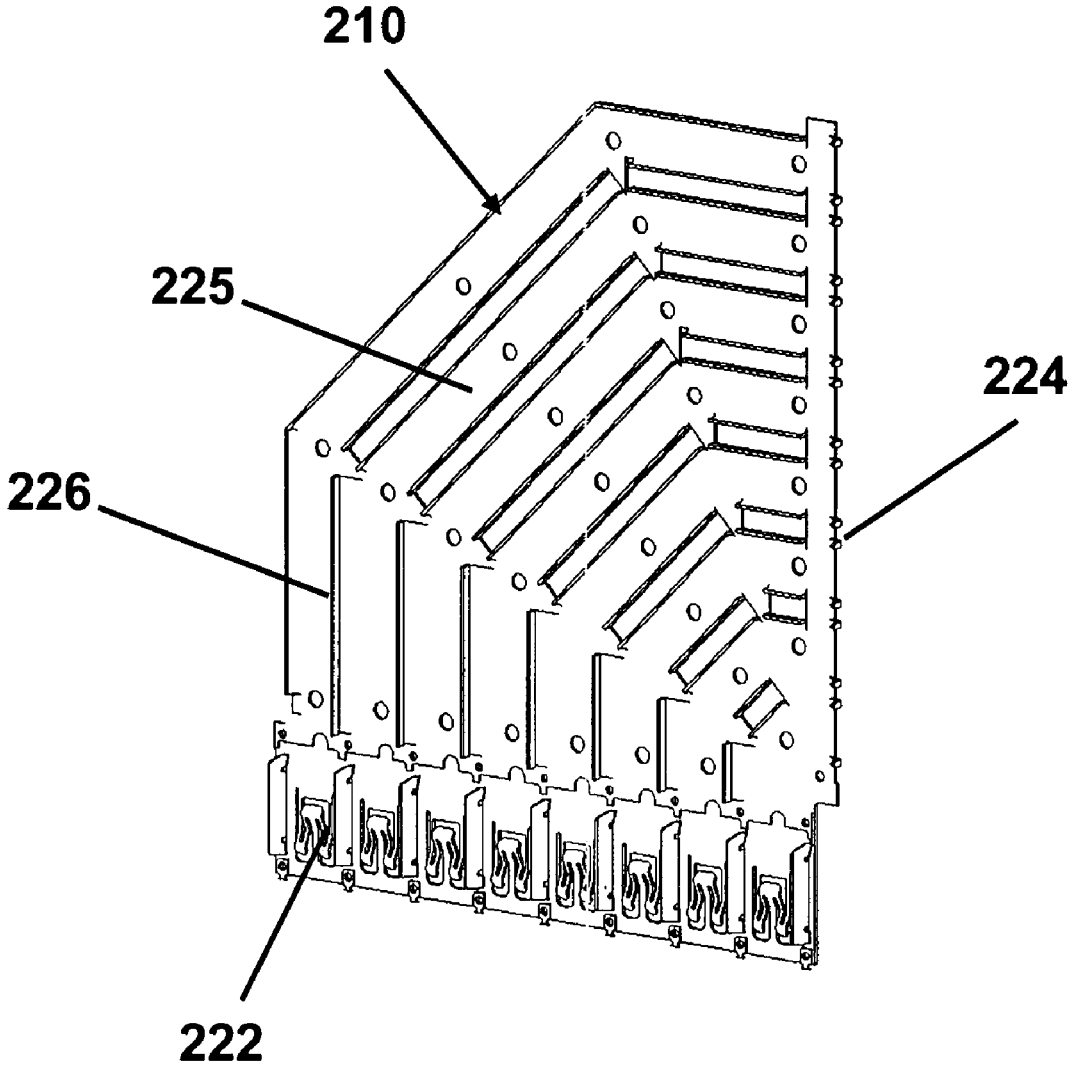
FIG. 8 is a perspective view of the shield plate illustrated in FIG. 7.

Referring to FIG. 8, the shield plate 210 is shown without differential signal conductors 217. The shield plate 210 may be formed by stamping conductive metal and then deforming the stamped conductive metal shape appropriately. The shield plate 210 is preferably formed by progressive die stamping. Conductive metals include metals, both elemental and alloys, with or without plating, such as, but not limited to, silver, gold, copper, nickel, tin, aluminum, tin/lead alloy, brass, and other similar conductive metals.

Disposed along at least one edge is at least one grounding contact portion 222 or 224. In the embodiment depicted, the shield plate 220 has two sets of grounding contact portions 222 and 224. The grounding contact portion 222 or 224 can be any suitable arrangement for forming an electrical contact including, but not limited to, a press-fit contact, a pressure-mount contact, a paste-in-hole solder attachment, a separable mating interface, or some other arrangement. Each of the grounding contact portion 222 or 224 may be the same arrangement or each grounding contact portion 222 or 224 may be a different arrangement for electrical and mechanical coupling.

Several projections 226 and divider shields 220 provide shielding between adjacent differential signal conductors 217 to reduce crosstalk therebetween. The divider shields 220 provide shielding and reduce crosstalk between adjacent pairs of contact portions 216, while the projections 226 provide shielding for other parts of the differential signal conductors 217. The divider shields 220 are preferably formed from conductive metal so as to increase the metal presence around the contact region.

The projections 226 are disposed substantially perpendicular to the plane of the shield plate 210 and spaced apart to receive the differential signal conductors 217. The projections 226 form channels 225 where each channel 225 preferably receives the differential signal conductors 217. The differential signal conductors 217 may be substantially disposed within insulation before being placed in the channel 225. The channel 225 has a contour which substantially outlines the shape of the differential signal conductors 217 to be received in that channel 225. The projections 226 are preferably formed integrally with the shield plate 210 by progressive die stamping. Through progressive die stamping, portions of the shield plate 210 can be cut into and deformed to form the projections 226. To form a channel 225 that will accept the shape of a particular signal conductor, several projections 226 may be needed. In the embodiment shown, the channels 225 have three projections 226 on either side to accept a substantially linear shape with two bends. The projections 226 may also be disposed within shield insulation 114.

Figure 9:
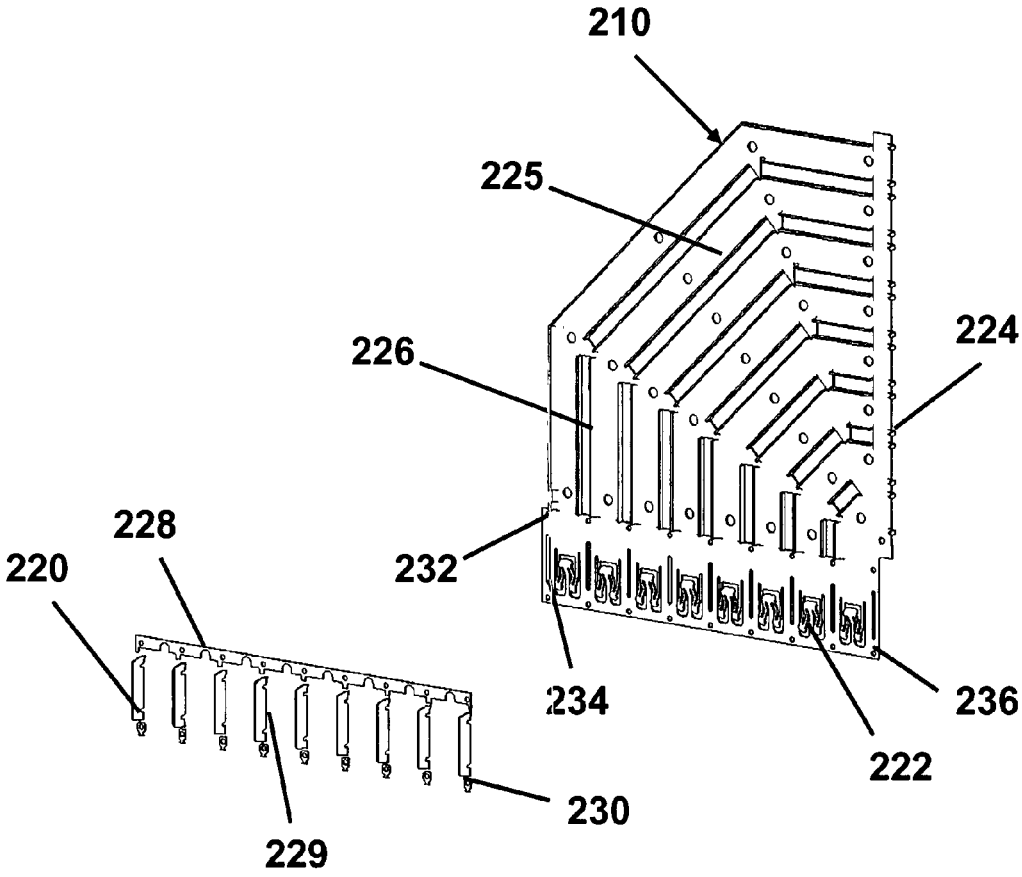
FIG. 9 is an exploded perspective view of the shield plate and a divider shield of the shield plate illustrated in FIG. 7.

Referring to FIG. 9, the shield plate 210 is shown with the divider shield 220. The divider shields 220 are shown formed separately before attachment to the shield plate 210. Separately formed divider shields 220 provide more metal shielding when compared to forming the divider shields 220 integrally with the shield plate 210.

The divider shields 220 are disposed on the shield plate 210 near where the contact portions 216 of the differential signal conductors 217 will be received by the shield plate 210. The divider shields 220 provide shielding and crosstalk reduction between adjacent contact portions 116 of the differential signal conductors 217. The divider shields 220 are placed substantially perpendicular to the plane of the shield plate 210 on either side of where the contact portion 216 is received. In the embodiment shown, the divider shields 220 have a substantially trapezoidal shape, however, any suitable shape may be used to form the divider shields 220 depending upon the particular application.

The divider shields 220 may be formed integrally with the shield plate 210, or the divider shields 220 may be formed separately and then attached to the shield plate 210. Preferably, the divider shields 220 are formed separately from the shield plate 210 and then attached to the shield plate 210 by suitable methods, such as by, but not limited to, press-fitting, screw fastening, bolting, rivet fastening, welding, and using an adhesive agent. Similarly formed divider shields 220 could be used to replace some or all of the projections 226. If the divider shields 220 replace some or all of the projections 226, the corresponding portion of the shield plate 210 can be substantially planar and more continuous.

The shield plate 210 along with the projections 226 and the divider shields 220 may be disposed in the shield insulation 114, however preferably only the shield plate 210 and the divider shields 220 are disposed within the shield insulation 114 by injection molding, as best shown in FIG. 2. The shield insulation 114 may be provided only on one side of the shield plate 210 so that the shield plate 210 is sandwiched between the conductor insulation 112 and the shield insulation 114.

When formed separately, the divider shields 220 are formed by stamping a sheet of conductive metal, preferably by progressive die stamping, and then attaching to the shield plate 210, such as by press-fit. In the embodiment depicted, a divider shield assembly 221 is formed with the divider shields 220, a tab 229, a connecting strip 228, and a connecting foot 230. Preferably all the divider shields 220 are formed integrally with the connecting strip 228 so that multiple divider shields 220 extend downwardly from the connecting strip 220 and project outwardly from the face of the shield plate 210. Each divider shield 220 has the tab 229 and the connecting foot 230. The tabs 229 are inserted into the slots 234 of the shield plate 210 to couple the divider shield assembly 221 to the shield plate 210. First posts (not shown) are disposed on the connecting strip 228 has so that the divider shield assembly 221 can couple to the shield plate 210 by inserting the first posts (not shown) into holes 232 on the shield plate 210. Similarly, second posts (not shown) are disposed on the connecting foot 230. The divider shield assembly 221 couples to the shield plate 210 by inserting the second posts (not shown) into holes 236 on the shield plate 210. The first and second posts (not shown) and the holes 232 and 236 may form a press-fit coupling, a snap coupling, a rivet coupling or other similar couplings. The conductive metal used to form the divider shield assembly 221 may be an elemental metal or an alloy, plated or unplated, and includes, but is not limited to, silver, gold, copper, nickel, tin, aluminum, tin/lead alloy, brass, and other similar conductive metals.

As apparent from the above description, the present invention provides an electrical connector. Signal conductors substantially within conductor insulation is placed on a shield plate with a divider shield. The signal conductors have contact portions, and the divider shield formed of conductive material is placed on the shield plate near the contact portions.

Accordingly, when the electrical connector is coupled to another signal path, crosstalk in the contact region is minimized by the divider shields. Crosstalk is minimized by the divider shields increasing the metal present in the contact region. Furthermore, the divider shield lowers the cost of creating the electrical connector by avoiding more costly materials such as plastic containing conductive materials.

While a particular embodiment has been chosen to illustrate the invention, it will be understood by those skilled in the art that various changes and modifications can be made therein without departing from the scope of the invention as defined in the appended claims.

What is claimed is:

1. A wafer for an electrical connector comprising:

a conductive shield plate having at least one slot;

a plurality of signal conductors disposed on the shield plate, each of the plurality of signal conductors having at least one contact portion; and a divider shield assembly, the divider shield assembly including, a connecting strip, and a divider shield extending from the connecting strip and disposed on the shield plate aligned with the at least one contact portion, the divider shield being made of conductive metal and having a tab extending therefrom, wherein the divider shield assembly is separate from and coupled to the shield plate by the at least one slot receiving the tab of the divider shield assembly.

2. The wafer according to claim 1, further comprising a shield insulation disposed around the shield plate and the divider shield.

3. The wafer according to claim 1, the shield plate having a plurality of projections, wherein the projections form channels therebetween and the channels receive at least one of the plurality of signal conductors.

4. The wafer according to claim 1, wherein each of the plurality of signal conductors is substantially disposed within a signal insulation formed to mate with the conductor insulation.

5. The wafer according to claim 1, further comprising a plurality of divider shields, wherein each of the plurality of divider shields has a first end connected to the connecting strip and a second end forming a connecting foot.

6. The wafer according to claim 5, wherein the connecting strip and the connecting foot are connected to the shield plate.

7. The wafer according to claim 1, wherein the signal conductor is a differential pair.

8. An electrical connector comprising:

at least one wafer, the wafer including:

a conductive shield plate having at least one slot, a plurality of signal conductors disposed on the shield plate, each of the plurality of signal conductors having at least one contact portion, and a divider shield assembly, the divider shield assembly including, a connecting strip, and a divider shield extending from the connecting strip and disposed on the shield plate aligned with the at least one contact portion, the divider shield being made of conductive metal and having a tab extending therefrom, wherein the divider shield assembly is separate from and coupled to the shield plate by the at least one slot receiving the tab of the divider shield assembly; and an end module.

9. The electrical connector according to claim 8, further comprising a shield insulation disposed around the shield plate and the divider shield.

10. The electrical connector according to claim 8, the shield plate having a plurality of projections disposed on the shield plate, wherein the projections form channels therebetween and the channels receive at least one of the plurality of signal conductors.

11. The electrical connector according to claim 8, wherein each of the plurality of signal conductors is substantially disposed within a signal insulation formed to mate with the conductor insulation.

12. The electrical connector according to claim 8, further comprising a plurality of divider shields, wherein each of the plurality of divider shields has a first end connected to the connecting strip and a second end forming a connecting foot.

13. The electrical connector according to claim 12, wherein the connecting strip and the connecting foot are connected to the shield plate.

14. The electrical connector according to claim 10, wherein the signal conductor is a differential pair.

15. A shield plate for a wafer comprising:

a plurality of signal conductors, each signal conductor having an intermediate portion and a contact portion;

a conductive layer formed to receive the intermediate portion of the plurality of signal conductors;

at least one slot disposed in the conductive layer; and a divider shield assembly, the divider shield assembly including, a connecting strip, and at least one divider shield extending from the connecting strip and disposed substantially orthogonal to a plane of the conductive layer and disposed between adjacent contact portions of adjacent signal conductors, the divider shield being made of conductive metal and having a tab extending therefrom, wherein the divider shield assembly is separate from and coupled to the shield plate by the at least one slot receiving the tab of the divider shield assembly.

16. The shield plate according to claim 15, further comprising a shield insulation disposed around the shield plate and the divider shield.

17. The shield plate according to claim 15, further comprising a plurality of projections disposed on the shield plate, wherein the projections form channels therebetween and the channels receive the intermediate portion of a respective one of the plurality of signal conductors.

18. The shield plate according to claim 15, further comprising a plurality of divider shields, wherein each of the plurality of divider shields has a first end connected to the connecting strip and a second end forming a connecting foot.

19. The shield plate according to claim 18, wherein the connecting strip and the connecting foot are connected to the shield plate.

20. The shield plate according to claim 15, wherein the signal conductor is a differential pair.

* * * * *